United States Patent [19]

Donovan

[11] 4,250,125

[45] Feb. 10, 1981

[54] SLIDE VALVE CARBURETOR IDLE FUEL DELIVERY SYSTEM

[75] Inventor: Daniel L. Donovan, Decatur, Ill.

[73] Assignee: Borg-Warner Corporation, Chicago, Ill.

[21] Appl. No.: 58,036

[22] Filed: Jul. 16, 1979

[51] Int. Cl.[3] ..... F02M 9/06

[52] U.S. Cl. ..... 261/41 B; 261/44 A; 261/44 B

[58] Field of Search ..... 261/44 B, 44 C, 67, 261/44 A, 41 B

[56] References Cited

U.S. PATENT DOCUMENTS

| | | | |
|---|---|---|---|
| 1,151,578 | 8/1915 | Entz | 261/44 B |
| 1,604,279 | 10/1926 | Guy | 261/44 B |
| 1,675,344 | 7/1928 | Guthrie | 261/67 |
| 2,363,223 | 11/1944 | Bonnier | 261/44 C |
| 3,329,413 | 7/1967 | Date | 261/44 C |
| 3,342,463 | 9/1967 | Date et al. | 261/44 C |
| 3,734,473 | 5/1973 | Moriya et al. | 261/44 C |
| 3,752,454 | 8/1973 | Korponay | 261/44 B |
| 3,985,839 | 10/1976 | Edmonston | 261/44 B |
| 4,044,080 | 8/1977 | Matsumoto et al. | 261/44 B |
| 4,097,562 | 6/1978 | Blakeway | 261/44 |
| 4,117,810 | 10/1978 | John | 261/44 B |
| 4,133,848 | 1/1979 | Black | 261/44 A |
| 4,150,070 | 4/1979 | Hashimoto et al. | 261/44 B |

FOREIGN PATENT DOCUMENTS

| | | | |
|---|---|---|---|
| 731782 | 2/1943 | Fed. Rep. of Germany | 261/44 B B |
| 734055 | 4/1943 | Fed. Rep. of Germany | 261/44 B |
| 6694 | of 1914 | United Kingdom | 261/44 B |
| 3026 | of 1915 | United Kingdom | 261/44 B |
| 119187 | 9/1918 | United Kingdom | 261/44 C |
| 162369 | 4/1921 | United Kingdom | 261/44 B |
| 223773 | 10/1924 | United Kingdom | 261/44 B |
| 228300 | 2/1925 | United Kingdom | 261/44 B |
| 299191 | 10/1928 | United Kingdom | 261/44 B |
| 375419 | 6/1932 | United Kingdom | 261/44 B |
| 490111 | 8/1938 | United Kingdom | 261/44 B |
| 734529 | 8/1955 | United Kingdom | 261/44 B |

*Primary Examiner*—Tim R. Miles

*Attorney, Agent, or Firm*—Florian S. Gregorczyk

[57] ABSTRACT

A slide valve carburetor includes an idle fuel system to deliver fuel to the central downstream portion of the main air induction passage. The idle fuel delivery system is sequentially occluded as the driven device attains full-throttle operation, and can be designed to allow passage of supplementary fuel at full or partial throttle operation.

8 Claims, 3 Drawing Figures

SLIDE VALVE CARBURETOR IDLE FUEL DELIVERY SYSTEM

BACKGROUND OF THE INVENTION

The present invention includes an idle fuel delivery system for a slide valve type carburetor. Such carburetors generally have a body defining an air induction passage, and a fuel nozzle adjacent or extending into the induction passage. The induction passage and a fuel well are connected by an orifice in the fuel nozzle. A slide valve is disposed to travel perpendicular to the induction passage and thereby produce a variable Venturi effect. Affixed to the slide valve is a tapered metering pin which extends into the orifice. Withdrawal of this tapered pin from the orifice during the operation of the carburetor increases the exposed cross-sectional area of the pin, thereby allowing a larger volume of fuel to pass from the fuel well to the induction passage for capture and mixing with the rapidly moving airstream for combustion in the engine.

Idle fuel delivery is conventionally introduced to the air passage through ports at the surface of the air passage on the downstream side of the slide valve. Idle fuel entering this air passage has close proximity to the air induction passage wall, which has a tendency to be relatively cool and therefore promotes fuel condensation. Other slide valve carburetors introduce supplemental fuel through ports in the air passage sidewall; however, the condensation problem is still present. One attempt to overcome this problem involved the collection of the condensate and its reentrainment into the airstream at a more central location in the cross section of the air passage.

A primary objective of the present invention is to achieve better fuel disbursement and consequently fuel entrainment, and thereby minimize the fuel condensation and resultant fuel losses, especially at low engine speeds.

Another objective is to eliminate the delivery of idle fuel as the carburetor attains a normal operational mode, to improve the operating economy.

SUMMARY OF THE INVENTION

A carburetor constructed in accordance with this invention has a body defining both an air induction passage extending therethrough, and a guide passage substantially perpendicular to the air induction passage. A slide valve is mounted in the guide passage for movement in a direction perpendicular to the air induction passage. A float bowl is affixed to the carburetor body and cooperates with the carburetor body to define the main fuel well, and a main fuel nozzle has an orifice communicating between the main fuel well and the induction passage. A main fuel metering pin is received within the main fuel nozzle and is movable with the slide valve for varying the effective cross-sectional area of the main fuel nozzle orifice.

Particularly in accordance with the invention, the carburetor comprises an idle fuel system in which the slide valve has wall portions defining an idle fuel chamber. One of the slide valve wall portions defines at least one idle fuel aperture opening into the induction passage downstream from the main fuel nozzle. The fuel delivery ports are spaced from each other along the slide valve wall portion along an axis parallel to the longitudinal axis of the main fuel metering pin. Means, including the carburetor body, is provided for occluding the idle fuel aperture as the slide valve is retracted within the guide passage to withdraw the main fuel metering pin.

In accordance with another aspect of the invention, the slide valve wall portion defines a plurality of idle fuel apertures, which are sequentially occluded as the slide valve is retracted.

In accordance with still another aspect of the invention, the main fuel metering pin can be made hollow, and thus provide a passage for delivery of the idle fuel to the idle fuel chamber.

THE DRAWINGS

In the several figures of the drawings, like reference numerals identify like components, and in those drawings.

DETAILED DESCRIPTION OF THE INVENTION

Figure 1:
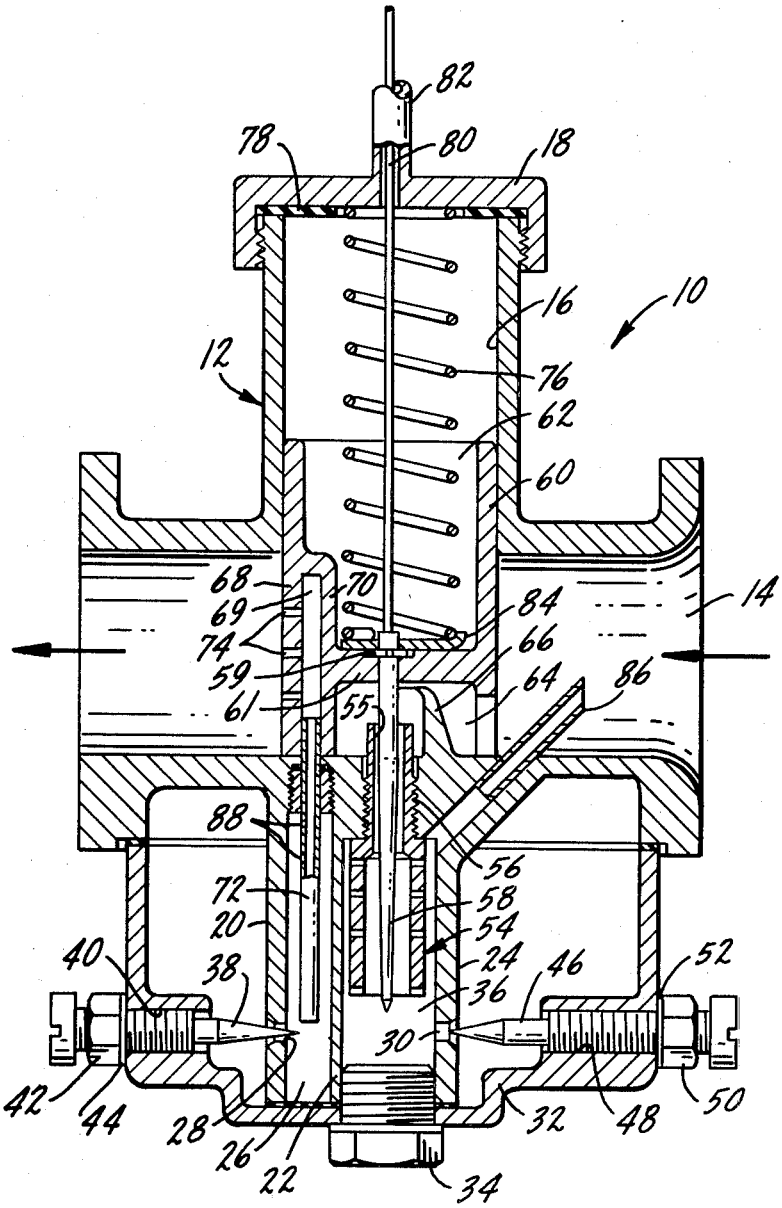
FIG. 1 is a cross-sectional view of a carburetor incorporating the principles of this invention.

In FIG. 1 the carburetor itself is generally indicated by reference numeral 10 and has three main components. The first main component is a central body portion 12, which itself has a central portion defining an air induction passage 14, and another portion which defines a guide passage 16 disposed at substantially right angles to air induction passage 14. The second of the three main components is a cover 18, shown engaging central body portion 12 by mating threads. Of course welding or any other form of joinder can be used to secure the cover to central body portion 12 of the carburetor.

Central body portion 12 of the carburetor also includes three depending wall portions 20, 22 and 24. Wall portions 20 and 22 cooperate to define an idle fuel well 26 between these walls. Wall portion 20 also defines a first orifice 28 which, absent any other components, serves to regulate the rate of idle fuel delivery.

Wall portion 24 similarly defines a second orifice 30 which, without any other components, would serve to regulate the rate of main fuel delivery in a similar manner. The lower, inner sides of the wall portions 22, 24 define a plurality of threads. A float bowl 32, the third main component, is affixed to central body portion 12, using a screw fastener 34 which has threads in mating engagement with correspondingly threaded portions of walls 22, 24. A main fuel well 36 is defined between the wall portions 22, 24, just above the screw fastener 34. Because fastener 34 extends through the float bowl, in a sense main fuel well 36 is defined by depending wall portions 22, 24 and float bowl 32. An idle adjustment screw 38 has a needle point extending into orifice 28, and has a threaded portion received in a correspondingly tapped portion 40 in a side wall of float bowl 32. A locknut 42 and washer 44 are used in a well-known manner to retain the needle screw position 38 in its proper location after adjustment. Another needle screw 46 is provided and positioned with its point in orifice 30, thereby providing a flow adjustment for delivery of the main fuel from the float bowl into well 36. Screw 46 likewise is received in a threaded portion 48 of the side wall of float bowl 32, and another locknut 50 and washer 52 are provided to retain this component in place after the main fuel flow adjustment has been made. Locknuts 50 and 42 also function as sealing glands to prevent fuel leakage from float bowl 32.

Main fuel nozzle assembly 54 includes a main fuel nozzle orifice 55 and a threaded portion 56 received in a correspondingly tapped bore in the center of central body portion 12. A main fuel metering pin 58 has a tapered shank which extends upwardly through the main channel of the fuel delivery passage in nozzle assembly 54. Main fuel metering pin 58 has holes or notches (not shown) in its upper body length to receive an E-clip or other retaining means (not separately illustrated). Thereafter the retaining means for pin 58 is positioned in a counterbore or recess 59 of a web 61 of a slide valve 60.

Slide valve 60 has its outer cylindrical portion received within guide passage 16 as shown, and slide valve 60 at its lower portion abuts central body portion 12 of the carburetor. Slide valve 60 is generally H-shaped in section, and defines an upper chamber 62 and a lower chamber 64 as shown. Most of the air-fuel mixing occurs in the area of lower chamber 64. The fuel passes the metering pin 58 and shrouded lip 66 of central body portion 12 to encounter the moving air in which it is entrained and displaced to the left as shown in the drawing for delivery to en engine (not shown). The left section of H-shaped slide valve 60 is separated to provide an outer wall portion 68 and an inner wall portion 70. Wall portions 68, 70 cooperate to define an idle fuel chamber 69 of the carburetor. A hollow tube 72 is positioned between the two wall portions 68, 70, and extends through an opening in central body portion 12 to communicate with idle fuel well 26. Wall portion 68 defines a plurality of idle fuel apertures 74 to pass fuel from idle fuel chamber 69 into the central portion of air induction passage 14. Although a plurality of apertures 74 are shown, a single aperture could be provided, depending upon engine operating requirements.

The upper end of metering pin 58 extends through a suitable bore in web 61 in the H-shaped valve 60. A slide valve return spring 76, downwardly biased, is positioned between the web 61 of slide valve 60 and a gasket 78 at the closure end of the carburetor body, which gasket also serves as a guide for the upper spring end. The upper end of spring 76 rests against cover 18 and is retained as shown between the walls of the carburetor body and cover member 18 when the cover member is secured in place. A cable connector 80 is inserted in slide valve 60 through an attaching sleeve 82, and the lower portion of cable 80 is affixed to the valve 60 by a ball and keyhole, welding, soldering or other means, to thereby effect displacement of the slide valve 60 upwardly as a function of cable 80 displacement. A collar plate 84 rests against the lower end of spring 76, and contacts this lower end of spring 76 to centrally maintain this spring. Thus metering pin 58 is displaced upwardly and downwardly as a function of displacement of slide valve 60 and cable 80. A tube 86 is positioned contacting central portion 14 as shown to provide a communication between the air induction passage 14 and the volume adjacent the nozzle assembly 54. Thus tube 86 functions as the main fuel nozzle air bleed.

The various sealing arrangements such as gaskets and O-rings have not been described because of their small physical size, but those skilled in the art will readily appreciate their incorporation in this structure.

In operation, it is initially assumed that the engine with which the carburetor is associated has been started, with its purpose to accelerate a vehicle toward road speed, or suitably drive some other load to operating speed. Under these conditions, the components are in the normal idle position shown in FIG. 1, with slide valve 60 in its full downward position. Idle fuel is delivered through orifice 28 into idle fuel well 26, and passed upwardly through hollow tube 72 into idle fuel chamber 69, and thence through idle fuel apertures 74 into air induction passage 14. It is noted that idle fuel apertures 74 open into induction passage 14 on the downstream side of main fuel nozzle 54, at the upper end of nozzle 54. These apertures 74 thus discharge idle fuel into the approximate center of the Venturi, and on the downstream side, so that the idle fuel is entrained in the airstream at once without being deposited or condensed on any adjacent surface. This is a significant advantage over the system and operation of other slide valve carburetors in which there is a considerable problem with the condensation of the idle fuel as described earlier.

As the demand for additional fuel is delivered by movement of cable connection 80, the entire slide valve 60 is displaced upwardly, moving metering pin 58 with slide valve 60. This movement varies the effective cross-sectional area of main fuel nozzle orifice 55. Under these conditions, fuel is delivered from the main portion of float bowl 32 through orifice 30 into main fuel well 36, whence it is passed upwardly through nozzle assembly 54 around the metering pin 58, into orifice 55 and thus into air induction passage 14. The fuel is thus mixed to provide an appropriate air/fuel ratio mixture for delivery to the cylinders of the engine. It is apparent that more fuel will be delivered as the reduced-diameter portion of the metering pin is displaced upwardly into orifice 55. In addition, as slide valve 60 moves, idle fuel apertures 74 are also moved and are then sequentially occluded as they pass adjacent the inner walls of the portion 16. Accordingly, under rated load conditions, the entire fuel delivery is through main fuel orifice 55, and idle fuel apertures 74 are closed off to prevent the discharge of additional, unwanted fuel. This closure achieves an economy of operation by not wasting the idle fuel under the full-throttle operating condition.

Figure 2:
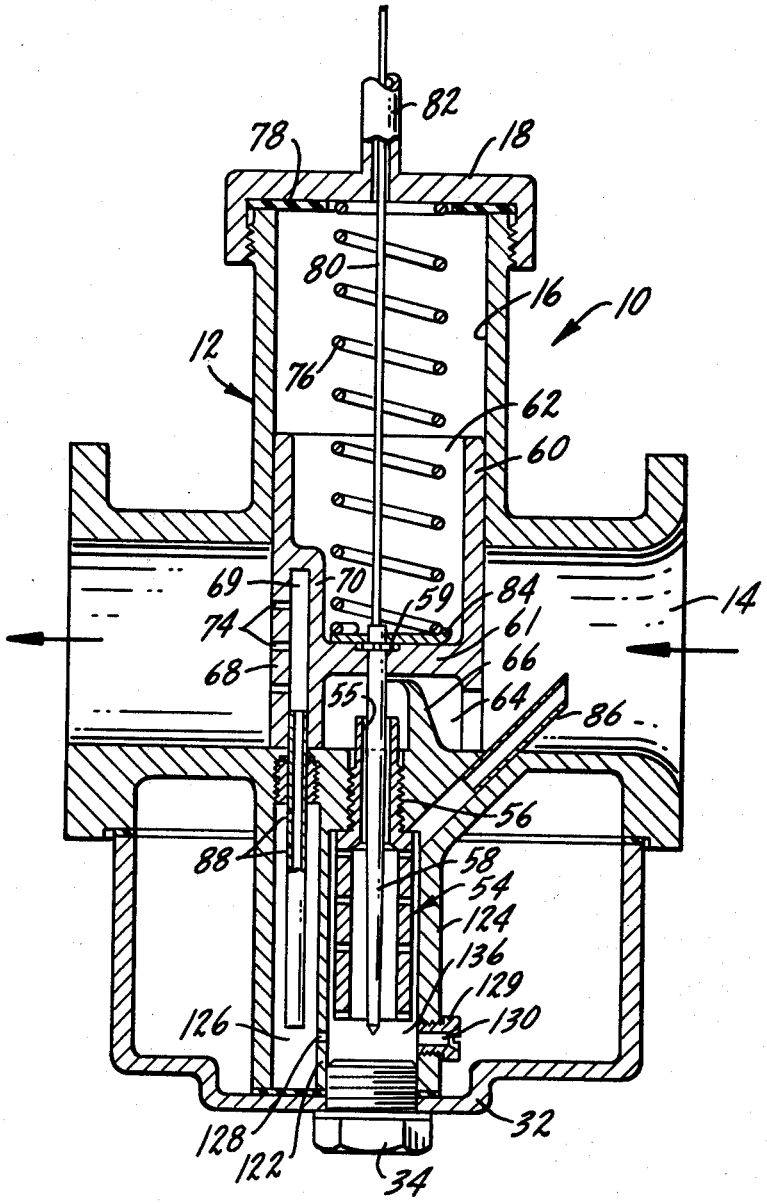
FIG. 2 is a cross-sectional view of an alternative embodiment of the invention.

FIG. 2 depicts another embodiment of the invention in which slide valve 60 and the idle fuel apertures 74 are identical in arrangement to that shown in FIG. 1. However, in the arrangement of FIG. 2, there is no provision for adjusting the volume of main fuel or idle fuel delivered through the carburetor. As shown an idle fuel delivery orifice 128 is a fixed orifice in a wall 122 of the carburetor body 12. A screw-type member 129 defining a hollow interior channel 130 is inserted in wall portion 124 of the carburetor body. Channel 130 functions as the main fuel control channel to meter the flow of fuel from float bowl 32 into a main fuel well 136. Orifice 128 meters the flow from main fuel well 136 into an idle fuel well 126. In all other respects the construction and operation of the embodiment shown in FIG. 2 are the same as that in FIG. 1. Economies of assembly and material cost are realized by removing the adjustment screws 38 and 46 which regulate the effective orifice size for the main and idle fuel delivery systems in FIG. 1.

In the embodiments of FIGS. 1 and 2, hollow tube 72 defines supplementary fuel apertures 88 on the downstream side of the tube. This metering feature provides means for transporting a transition fuel flow for carburetor 10 at that point in the carburetor operation where the idle fuel flow is decreased or cut off, but before there is an increase in fuel delivery from main nozzle 55. For example, the smaller apertures 88 can be located to meter fuel to passage 14 as the idle fuel apertures 74 are closed but before main fuel nozzle 55 can supply adequate fuel to the induction passage during the fuel delivery transition from the idle fuel system to the main fuel system. This avoids the normal reliance in a slide valve type carburetor on early main nozzle fuel delivery at low air flows to fill that transition point between idle fuel flow and main fuel flow. In addition, these added apertures 88 serve as supplementary fuel passages at full or open throttle. It is the progressive opening of this secondary fuel supply that also contributes to fuel economy, because an early, rich flow from the main nozzle is not required. The apertures 88 can be positioned in tube 72 such that they only meter fuel at wide open throttle and, therefore, only function as a supplemental fuel source.

Figure 3:
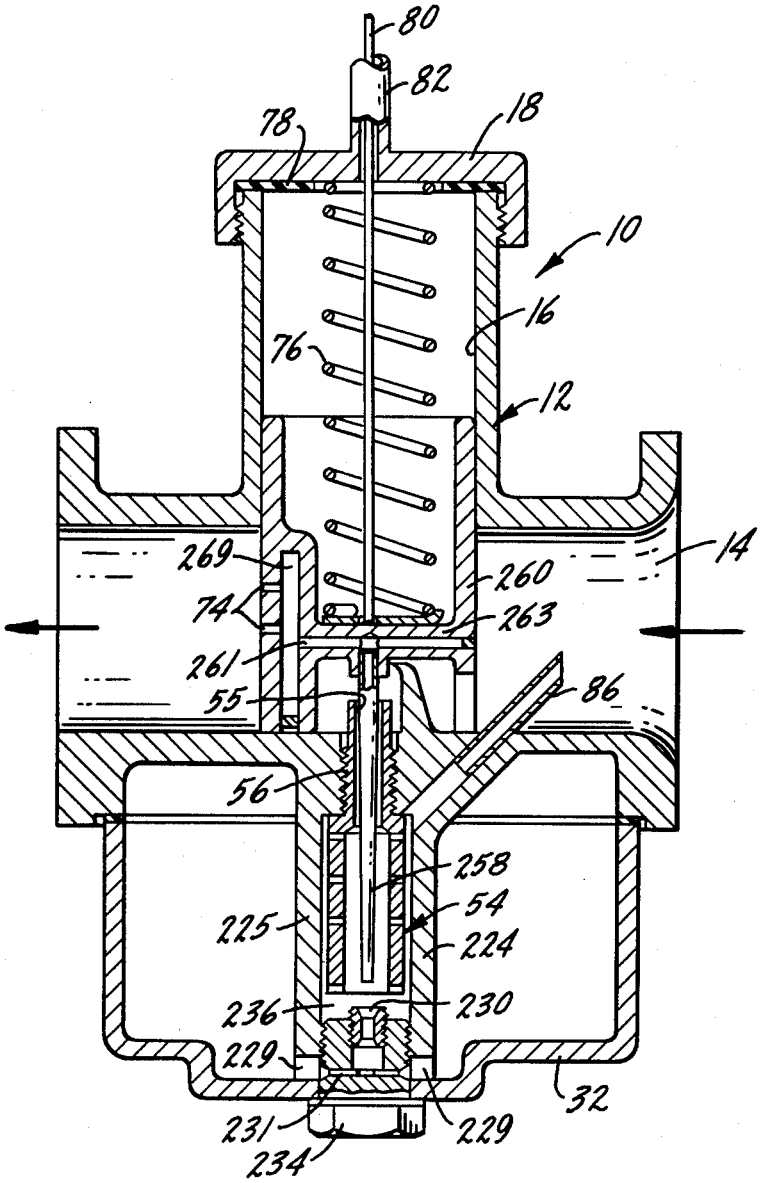
FIG. 3 is a cross-sectional view of yet another embodiment of the invention.

In the embodiment of FIG. 3, there are two significant changes as contrasted to the earlier showings. First, the original screw fastener 34 for float bowl 32 is replaced by an attachment screw 234 which includes a fixed main fuel jet or orifice 230, aligned along the center of the screw 234, and communicating with a lateral passage 231 in the same screw. Walls 224, 225 of the carburetor body in this embodiment define apertures 229 to provide communication between the interior of float bowl 32 and laterial passage 231 in attachment screw 234. Thus fuel can pass from float bowl 32 through apertures 229, lateral passage 231 and upwardly through orifice 230 into main fuel well 236 of the carburetor in this arrangement. The second major change is that the original metering pin 58 is replaced by a hollow metering pin 258. This pin 258 not only regulates delivery of the main fuel between its outer periphery and the adjacent portion of the nozzle assembly 54 as already described, but in addition meters the idle fuel through its hollow interior upwardly to a communicating lateral passage 261 in a horizontal web 263 of an H-shaped slide valve 260. Thus, the idle fuel passes through the metering pin, across lateral passage 261, and into an idle fuel chamber 269. Idle fuel apertures 74 function precisely the same as previously disclosed, that is, to meter the idle fuel into the proper portion of the airstream on the downstream side of slide valve 260. The system of FIG. 3 realizes certain cost advantages over the earlier described embodiments.

Those skilled in the art will recognize that certain variations can be made in the illustrated embodiments. By way of example, the idle fuel tube can be offset as much as 90 degrees, such that it is located at the side of the nozzle well and thus the air bleeds and the adjustment can be made above the float bowl fuel level. The idle fuel delivery ports need not be precisely centered in the airstream, but can be offset when the idle fuel tube is moved to the side of the nozzle fuel well.

While only specific embodiments of the invention have been described and shown, it is apparent that various alterations and modifications can be made therein. It is therefore the intention in the appended claims to cover all such modifications and alterations as may fall within the true scope and spirit of the invention.

I claim:

1. A carburetor having a body defining both an air induction passage extending therethrough and a guide passage substantially perpendicular to the air induction passage, a slide valve mounted in said guide passage for axial movement in said guide passage in a direction perpendicular to said air induction passage, said carburetor body having a plurality of depending wall portions, a float bowl affixed to said body, a main fuel well defined by certain of the depending wall portions and the float bowl, a main fuel nozzle having an orifice communicating between the main fuel well and said induction passage, and a main fuel metering pin received within said main fuel nozzle and movable with said slide valve for varying the effective cross-sectional area of the main fuel nozzle orifice, wherein the improvement comprises an idle fuel system in which the slide valve has wall portions defining an idle fuel chamber, one of said slide valve wall portions defining at least one idle fuel aperture opening into said induction passage downstream from said main fuel nozzle, means including the carburetor body for occluding the idle fuel aperture as said slide valve is retracted within said guide passage to withdraw the main fuel metering pin, one of said certain depending wall portions defining the main fuel well also defines an orifice in the wall, thus providing a fixed rate of main fuel delivery, and the other of said certain depending wall portions cooperates with another of the depending wall portions to define an idle fuel well, one of the idle fuel well wall portions defining an orifice to provide a fixed rate of idle fuel delivery to the idle fuel well which well communicates with the idle fuel chamber through a conduit means.

2. A carburetor as claimed in claim 1, wherein said one slide valve wall portion defines a plurality of idle fuel apertures spaced from each other along said one slide valve wall portion, and positioned such that the idle fuel apertures are sequentially occluded as the slide valve is retracted in the guide passage to withdraw the main fuel metering pin.

3. A carburetor as claimed in claim 1, and further comprising a pair of adjustable elements respectively associated with the main fuel well wall and idle fuel well wall orifices, such that adjustment of said elements effects a corresponding adjustment in the rate of main and idle fuel delivery.

4. A carburetor as claimed in claim 1, wherein a hollow tube is disposed to transport idle fuel from the idle fuel well to the idle fuel chamber.

5. A carburetor as claimed in claim 4, wherein said hollow tube defines at least one aperture opening on the downstream side of the slide valve, to deliver supplemental fuel both at the transition between idle fuel and main fuel delivery, and at full throttle.

6. A carburetor as claimed in claim 5, wherein said hollow tube defines a plurality of apertures opening on the downstream side of the slide valve.

7. A carburetor having a body defining both an air induction passage extending therethrough and a guide passage substantially perpendicular to the air induction passage, a slide valve defining a lateral passage and mounted in said guide passage for axial movement in said guide passage in a direction perpendicular to said air induction passage, said carburetor body having a plurality of depending wall portions, a float bowl affixed to said body, a main fuel well defined by certain of the depending wall portions and the float bowl, a main fuel nozzle having an orifice communicating between the main fuel well and said induction passage, and a main fuel metering pin received within said main fuel nozzle and movable with said slide valve for varying the effective cross-sectional area of the main fuel nozzle orifice, wherein the improvement comprises an idle fuel system in which the slide valve has wall portions defining an idle fuel chamber, one of said slide valve wall portions defining at least one idle fuel aperture opening into said induction passage downstream from said main fuel nozzle, and means including the carburetor body for occluding the idle fuel aperture as said slide valve is retracted within said guide passage to withdraw the main fuel metering pin which main fuel metering pin is a hollow tube providing a communicating means to said lateral passage, which passage communicates with and supplies idle fuel to the idle fuel chamber.

8. A carburetor as claimed in claim 7, wherein said one slide valve wall portion defines a plurality of idle fuel apertures spaced from each other along said one slide valve wall portion, and positioned such that the idle fuel apertures are sequentially occluded as the slide valve is retracted in the guide passage to withdraw the main fuel metering pin.

* * * * *